United States Patent [19]

Paulus

[11] 4,115,882

[45] Sep. 26, 1978

[54] FLUSH VALVE FOR TOILET TANKS

[76] Inventor: Paul Paulus, 3394 Paris Blvd., Westerville, Ohio 43081

[21] Appl. No.: 783,148

[22] Filed: Mar. 31, 1977

[51] Int. Cl.[2] ..... E03D 1/14

[52] U.S. Cl. ..... 4/327; 4/326; 4/345

[58] Field of Search ..... 4/67 A, 34, 37, 58, 4/55, 287

[56] References Cited

U.S. PATENT DOCUMENTS

| | | | |
|---|---|---|---|
| 934,353 | 9/1909 | Prichett | 4/37 |
| 2,066,796 | 1/1937 | Muller | 4/58 |
| 2,237,294 | 4/1941 | Easley | 4/37 |
| 3,665,526 | 5/1972 | Hoffman | 4/287 |
| 3,869,733 | 3/1975 | White | 4/67 A |
| 3,903,551 | 9/1975 | Johnson | 4/67 A |
| 3,913,149 | 10/1975 | Brinton | 4/67 A |
| 3,916,455 | 11/1975 | Longdin | 4/67 A |
| 4,042,982 | 8/1977 | Contreras | 4/67 A |

*Primary Examiner*—Henry K. Artis
*Attorney, Agent, or Firm*—Van D. Harrison, Jr.

[57] ABSTRACT

Disclosed is a flush valve for toilet tanks comprising in a general form a hollow tubular member having a valve head on its lower end and adapted at its upper end to seat with a second valve head. The lower end rests in a valve seat located in or near the bottom of the flush tank. A second valve head is positioned on or seats in the upper end of the tubular member. It is positioned so that it can be raised a short distance to permit the flow of water into the top of the tubular member and from thence into the stool below.

9 Claims, 9 Drawing Figures

FLUSH VALVE FOR TOILET TANKS

NATURE OF INVENTION

This invention relates to flush valves. More particularly it relates to flush valves for controlling the amount of water dispensed to a toilet bowl.

BACKGROUND OF THE INVENTION

The conservation of water is a matter of ever increasing importance. Erratic patterns of snowfall and rainfall, increased concentrations of population, and increased costs of making raw water acceptable to community use necessitates reduced consumption of water in many areas.

OBJECTS OF THE INVENTION

One object of this invention is to provide a flush valve for a toilet tank wherein alternative amounts of water can be consumed in the flushing operation. Still another object of this invention is to reduce the amount of water used in flushing a toilet stool. These and other objects of the invention will be readily apparent from the following description and drawings attached hereto.

SUMMARY OF THE INVENTION

Briefly stated this invention comprises a flush valve primarily for use in a toilet flush tank having a tip lever and a drain opening near or in the bottom of said flush tank comprising:

(a) a first tubular member having a longitudinal bore therethough and adapted at its upper end to seat and seal against a valve head;

(b) a first valve head fixed on the other end of the first tubular member and adapted to seal against the drain opening in the bottom of the tank;

(c) a guide engaging said first tubular member and adapted to guide it vertically;

(d) a second valve head adapted to seal against said one end of said first tubular member;

(e) means for attaching said second valve head to said trip lever;

(f) means attached to said first tubular member for arresting the upward travel of said second valve head relative to said first tubular member; and (g) means for equalizing the pressure between the interior of said first tubular member and the atmosphere when the water level around said first tubular member subsides below the top of said first tubular member.

DETAILED DESCRIPTION OF THE INVENTION

In the following description the flush valve of this invention is described as used in a flush tank equipped with a trip lever and flush handle attached to the lever for initiating flow of water from the tank and also equipped with a water inlet valve whose opening and closing is controlled by a float. The water inlet control valve and float control attached thereto do not form a part of the invention described herein.

Figure 1:
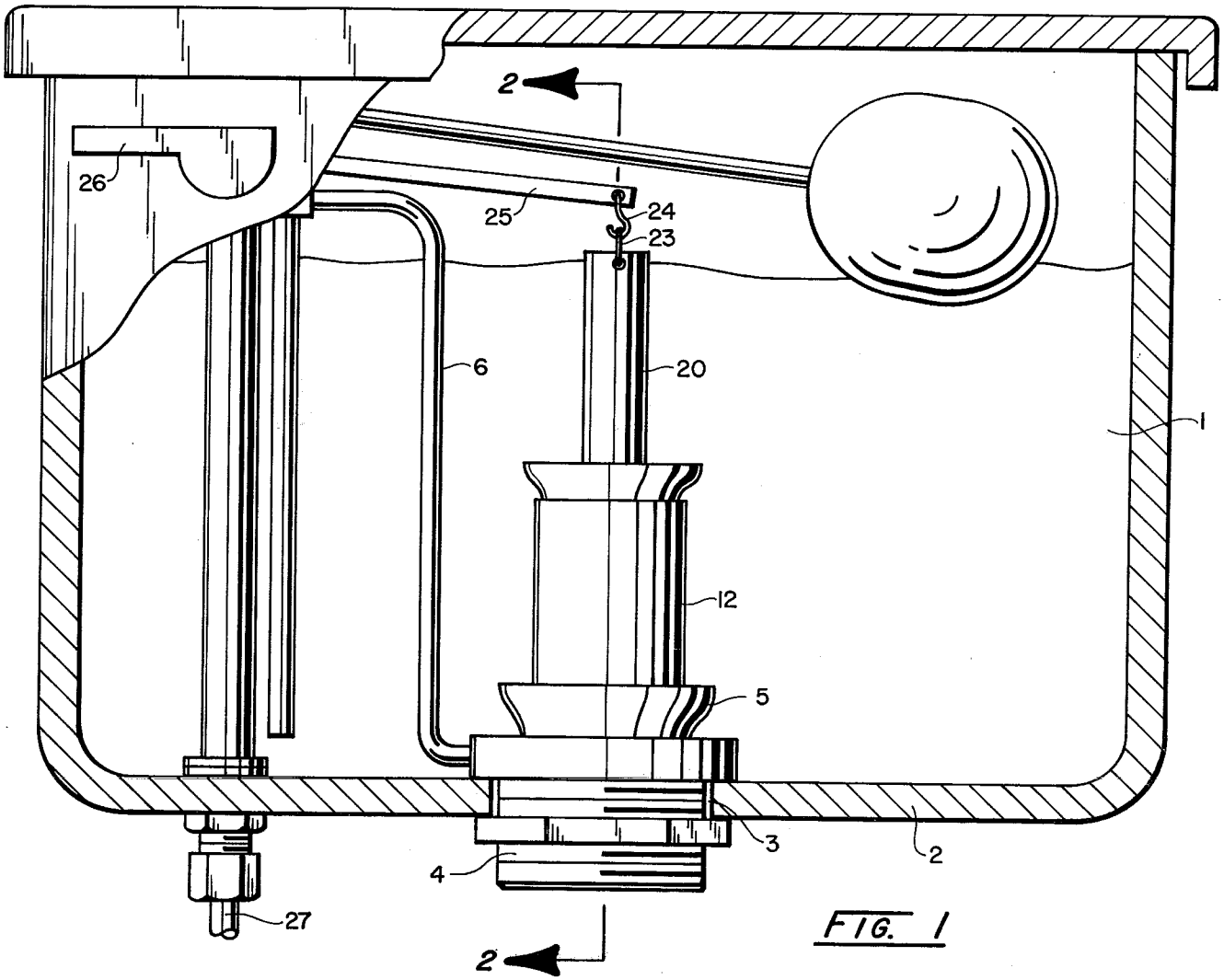
FIG. 1 is a front elevational view of a flush tank, with a portion of the tank broken away, showing a preferred embodiment of the flush valve of this invention in place.
Figure 2:
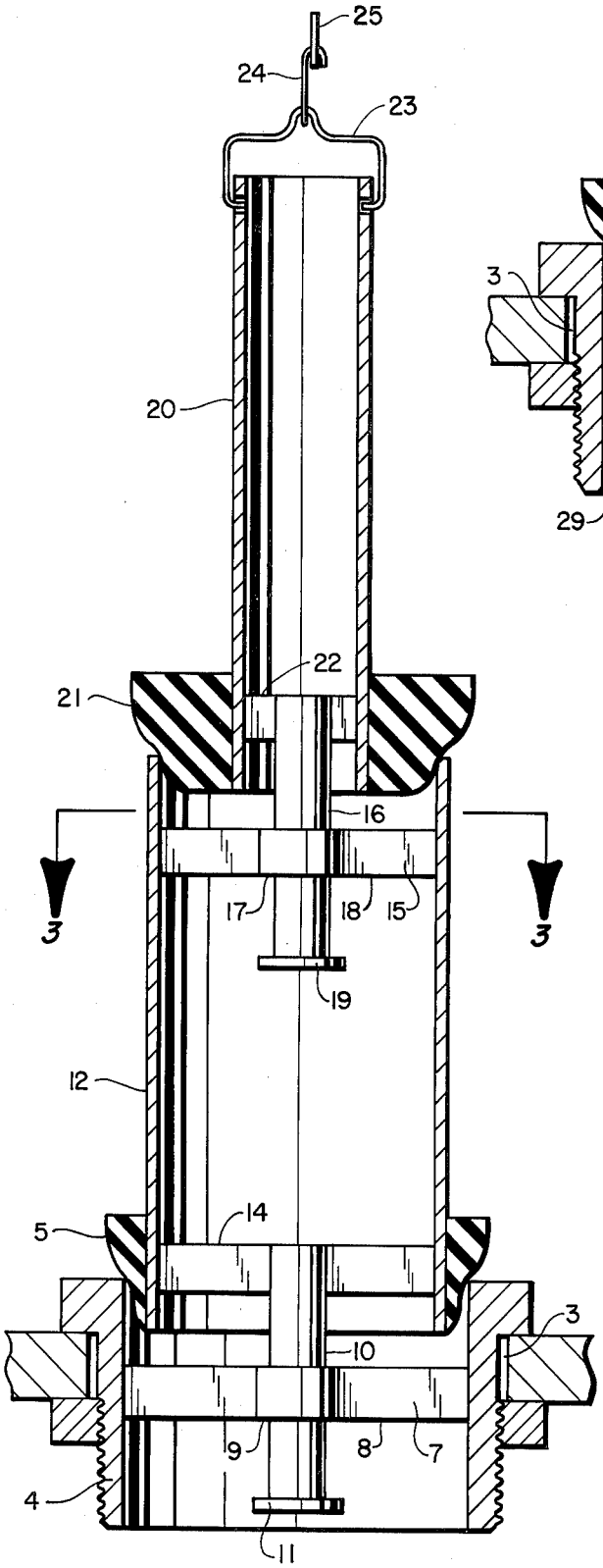
FIG. 2 is a sectional view of the flush valve in FIG. 1 taken along the line 2—2 in FIG. 1.

FIGS. 1, 2, 2A and 3 depict the most preferred, and it is believed best, embodiment of the flush valve of this invention. In FIG. 1 reference numeral 2 denotes generally the bottom of a toilet flush tank 1 having a drain opening 3. Drain tube 4 is fixed in opening 3 with a water-tight seal. The top end of drain tube 4 terminates in a valve seat or is otherwise adapted to form with valve head 5 a water tight seal when the opposing surfaces of each are seated together and water fills the tank 1. Bowl refill tube 6 connects to the water inlet control valve (not shown) and to drain tube 4 at a point below the juncture of valve head 5 and the top of drain tube 4. Bowl refill tube 6 supplies water to the trap of the toilet bowl connected to drain tube 4. It is preferable that the top of the drain tube 4 terminate somewhere near the bottom of the tank. Positioned rigidly in drain tube 4 is guide member 7. In FIG. 2 guide member 7 is shown as a rigidly fixed crossmember 8 supporting a coaxial collar 9. Rod 10 is free to slide in collar 9 but has at its lower end a circular flange 11 which prevents it from slipping upward completely and out of collar 9. The configuration of guide member 7 can, of course, be changed without departing from the spirit of the invention.

Rod 10 extends into upper tube 12 which carries on its lower end a valve head 5 adapted to seat against the top of drain tube 1. Crossmember 14 is attached to the interior of tube 12 and to rod 10 so that the two are aligned coaxially. Optionally rod 10 can be fixed in a sliding relationship with crossmember 14 but the more rigid structure is preferred. Mounted near the upper end of tube 12 is a third guide member 15 constructed much as in the manner of guide member 7. Rod 16 is free to slide in collar 17 rigidly supported by crossmember 18. Again a flange 19 prevents the withdrawal of rod 16 from collar 17. Rod 16 extends upward into a second tube 20. A second valve head 21 is fixed to the bottom of tube 20 and is adapted to form a water tight seal with the top of tube 12. A rigid crosspiece 22 attaches rod 16 to the interior of tube 20 in a coaxial alignment. Tube 20 extends vertically to a height slightly above the desired water level in the tank. The top of tube 20 is linked by any means desired such as bale 23 and hook 24 to the end of trip lever 25.

If it is desired to flush only liquid waste from the toilet bowl attached below the flush tank by drain tube 4, the trip lever 25 is raised by means of flush handle 26 to a point where tube 20 and valve head 21 attached thereto are lifted out of contact with the top of tube 12. Water will then flow in through the top of the tube 12, down through the center of tube 12, through drain tube 4, and into the toilet bowl. In the event it is desirable to flush solid waste from the toilet bowl, and a greater volume of water is required, trip lever 25 is raised by means of flush handle 26 to a point where flange 19 engages collar 17 and tube 12 and valve head 5 are raised out of contact with the top of drain tube 4. The flow of water through bowl refill tube 6 is regulated solely by the inlet valve on the water inlet line 27.

It is not readily apparent in this embodiment of the invention, but the open-ended hollow tube 20 serves the important function of admitting air to the interior of the tube 12 after valve head 21 has reseated on the top of tube 12 and the function of eliminating any pressure differential between the interior of tube 12 and the atmosphere. An appreciable part of the interior volume of tube 12 may still be filled with water when valve head 21 seats on tube 12. If no means is available to equalize the pressure between the atmosphere and the interior of tube 12, this retained water will cause valve head 5 to seat prematurely before all water present in the tank has flowed into drain tube 4. If, however, any pressure differential is eliminated, no water will be retained inside tube 12 and the flow of water through drain tube 4 will be unimpaired.

Figure 2A:
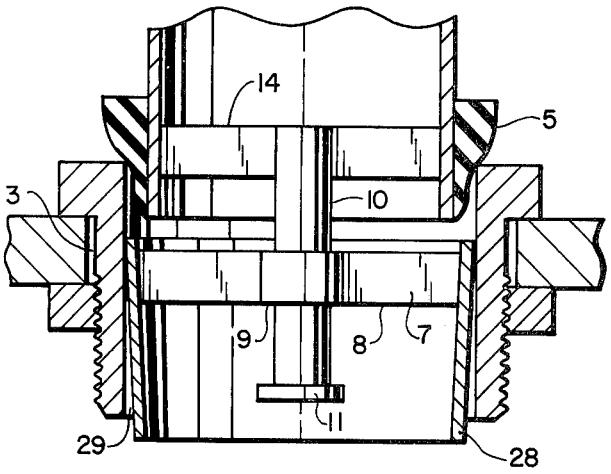
FIG. 2A is a cross sectional elevational view of a valve-seat adaptor in which the valve of FIG. 2 may be seated.
Figure 3:
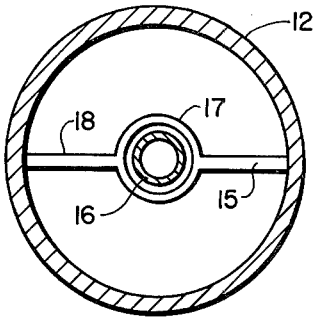
FIG. 3 is a horizontal cross section of the valve in FIG. 2 taken along the line 3—3.

In FIGS. 1 and 2 the flush valve of this invention is shown as an original part of the flush tank design. FIG. 2A illustrates how the valve of FIGS. 1 and 2 can be adapted to other tanks. In FIG. 2A reference numeral 28 designates a sleeve having a slightly conical shape conforming to the interior of the drain pipe outlet 29. Sleeve 28 can be screwed into, compressed, or otherwise anchored in drain pipe 29. The adaptor can be constructed of any suitable material such as plastic or hard rubber.

Figure 4:
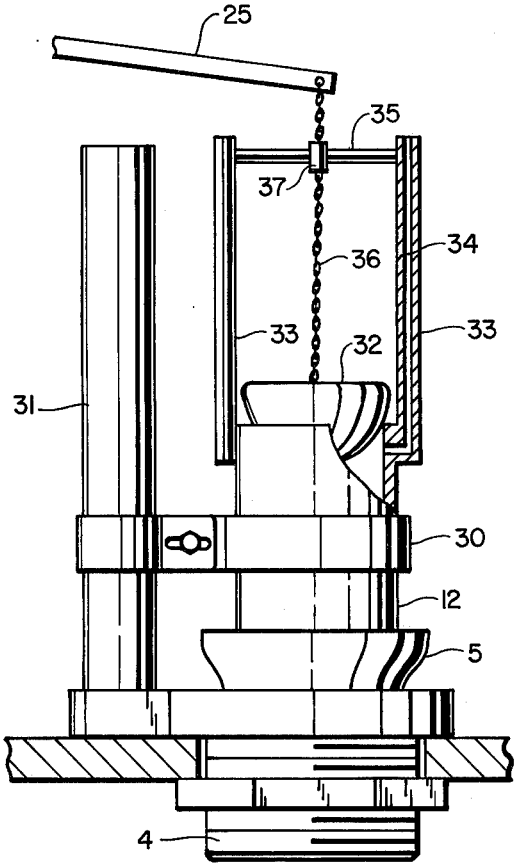
FIG. 4 is an elevational view of another embodiment of the invention with a portion broken away.

FIG. 4 depicts a modification of the invention wherein the lower valve head 5 and tube 12 have the same general configuration as in FIGS. 1 and 2. The means for guiding tube 12 is however a circular clamp 30 mounted on overflow pipe 31. In this modification valve head 32 rests on top of tube 12. A pair of risers 33, at least one of which has a hollow channel through it, are attached to tube 12 and extend vertically to a level above the level of the water in the flush tank. The hollow channel 34 in at least one of the risers provides a means of maintaining equal pressure between the atmosphere and the interior of tube 12 at all times since channel 34 penetrates the wall of tube 12 at a point below that where valve head 32 seats on tube 12. A cross piece 35 connects the two risers and a rod or chain 36 connected to valve head 32 and to trip lever 25 extends through sleeve 37 mounted in the center of crosspiece 35.

In the modification shown in FIG. 4, if it is desired to release only a lesser volume of water from the flush tank, trip lever 25 is raised only to a point where valve head 32 is lifted out of contact with the top of tube 12. If it is desired to release the full volume of water from the flush box, then valve head 32 is lifted by means of chain or rod 36 and lever 25 to a point where it engages crosspiece 35. Continued lifting unseats valve head 5 and permits water to flow through drain pipe 4. Hollow riser 34 admits air to the interior of tube 12 permitting all water to drain from the tube 12 and a complete flow of water from the tank.

Figure 5:
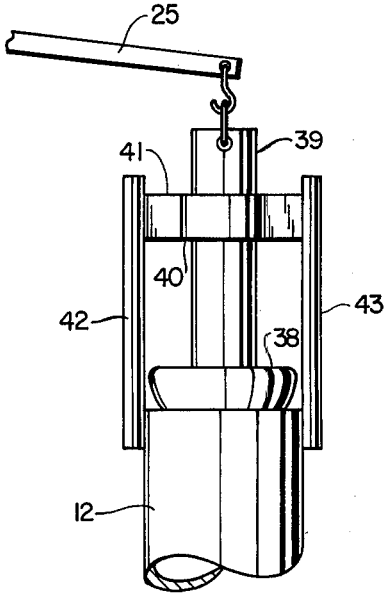
FIG. 5 is an elevational view of still another embodiment of the valve of this invention.

FIG. 5 presents a modified form of the valve shown in FIG. 4. For the valve head 32 of FIG. 4 there is substituted valve head 38 mounted on the end of open-ended tube 39. A bore hole extends through tube 39 and through the bottom face of valve head 38. Tube 39 is guided vertically by collar 40 centered by crosspiece 41 between risers 42 and 43. Tube 39 is connected at its upper end by any desired linkage to trip lever 25.

Raising valve head 38 to a level just below crosspiece 41 permits a lesser volume of water to flow into tube 12 and from there into drain pipe 4. When valve head 38 is raised to a sufficient height to engage crosspiece 41, further lifting will cause valve head 5 to rise and release the full volume of water. During the flushing step equal pressure within and without tube 12 is maintained by the hollow bore through tube 39.

Figure 6:
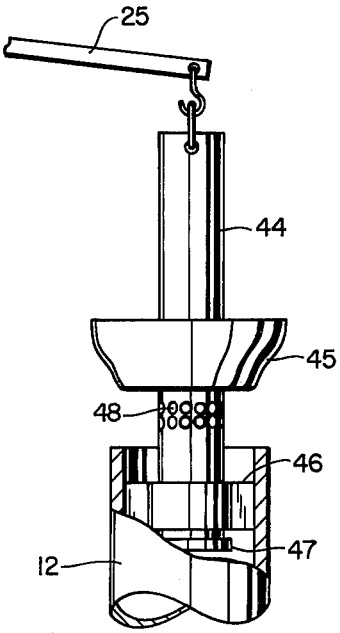
FIG. 6 is an elevational view of still another embodiment of the valve of this invention.

FIG. 6 depicts another configuration wherein hollow tube 44 extends through the face of valve head 45 and is free to slide vertically in the guide 46 constructed in the same fashion as guides presented earlier. Flange 47 on the lower end of tube 44 prevents tube 44 from slipping out of guide 46. Perforations 48 penetrate the wall of tube 44 at a location below valve head 45. During the flushing operation, when valve head 45 is reseated on the top of tube 12, pressure equilibrium is maintained by means of the perforations 48 which communicate between the hollow interior of tube 44 and the interior of tube 12. Tube 44 is open at its top end to the atmosphere.

Figure 7:
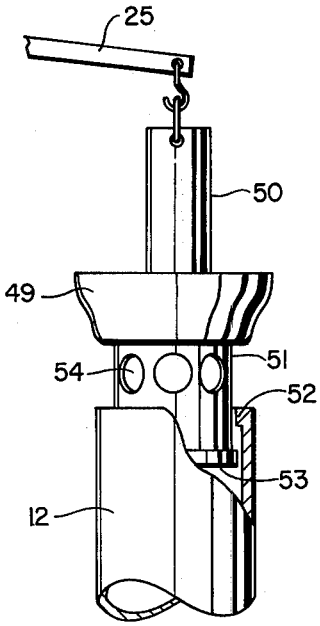
FIG. 7 is another embodiment of the valve of this invention.

FIG. 7 presents another embodiment of the invention. In this embodiment valve head 49 is located at the junction of tube 50 and cylinder 51. Tube 50 and cylinder 51 are extensions of each other and communicate completely. Cylinder 51 has limited telescopic movement within tube 12 and is penetrated about its circumference by a number of large holes 54 just below valve head 49. Circular shoulder 52 and circular flange 53 prevent cylinder 51 from disengaging from tube 12. In the flushing action, when trip lever 25 is raised to a point where flange 53 engages shoulder 52, water will flow through perforations 54 into the interior of cylinder 51 through tube 12, and on into the toilet stool. Further lifting of cylinder 51 and tube 50 will cause the lower valve head 5 to be unseated and to release a full volume of water.

It should be noted that in the embodiments shown in FIGS. 1, 2, 5, 6 and 7 no separate overflow pipe in the flush tank is required since each of the tubes 20, 39, 44 and 50 permits a ready flow of excess water through the open top of the upper tubular member.

Figure 8:
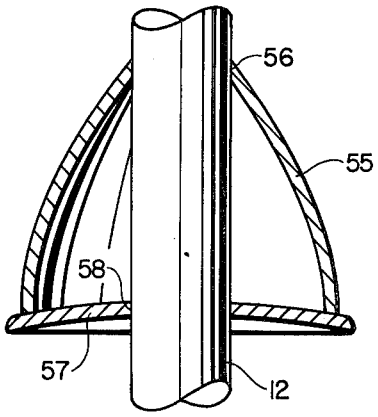
FIG. 8 is a vertical cross sectional view of an alternative valve head configuration.

Although the embodiments of this invention set forth by the accompanying drawings show a valve head having a near spherical surface, it is recognized that other types of valve seating configurations can also be utilized. For example, FIG. 8 shows a flapper type valve which can be substituted for either of the upper or lower valve heads in the drawings. In FIG. 8 bell-shaped chamber 55 is formed around and attached to tube 12 at 56 so that a volume of air is trapped and retained in chamber 55 sufficient to make it have the proper buoyancy. Flexible annular disk 56 is attached at 58 at a lower position on tube 12 just below the bottom of chamber 55. Disk 57 extends a radial distance slightly beyond the radius of air chamber 55 at its greatest diameter. Pressure of the edges of the air chamber 55 on the flexible edges of annular ring 57 (which can be made of rubber) assures a proper seal. This flapper valve can be adapted to seat either on top of tube 12 or drain pipe 4.

It is to be understood that the valve heads 5, 21, 32, 38 and 45 are of the proper buoyancy that they will rise and reseat properly. To this end the valve heads may be made either of a solid homogeneous material as indicated in the drawings or they can in part be hollow.

I claim:

1. A flush valve for use in a toilet flush tank having a trip lever and a drain opening from said tank comprising:

(a) a first vertically movable tubular member, open at each end, having a longitudinal bore therethrough and adapted at one end to seat and seal against a valve head;

(b) a first valve head fixed on the other end of said first tubular member and adapted to seal against the drain opening in said tank;

(c) a guide engaging said first tubular member and adapted to guide it vertically;

(d) a second valve head adapted to seal against said one end of said first tubular member;

(e) means for attaching said second valve head to said trip lever;

(f) means attached to said first tubular member for arresting the upward travel of said second valve head relative to said first tubular member; and (g) means for equalizing the pressure between the interior of said first tubular member and the atmosphere when the water level around said first tubular member subsides below the top of said first tubular member.

2. The flush valve of claim 1 wherein said means for equalizing comprises at least one or more substantially vertical hollow tubes each of whose upper ends extends above the uppermost level of water in said flush tank and whose lower ends is attached to and communicates with a channel penetrating the wall of said first tubular member at a location below the top of said tubular member.

3. The flush valve of claim 2 wherein said means for attaching said second valve head to said trip lever is a rod or chain attached at its lower end to said second valve head and pivotally attached at its upper end to said trip lever.

4. The flush valve of claim 3 wherein said means for arresting comprises a horizontal cross member positioned normal to the axis of said first tubular member, supported by said one or more vertical hollow tubes, and having a transverse hole therethrough aligned with the axis of said tubular member through which hole said rod or chain is inserted in a sliding relationship.

5. The flush valve of claim 1 wherein said means for attaching said second valve head to said trip lever and said means for equalizing the pressure comprises:

(a) a second hollow tubular member open at each end, having an upper end extending above the level of the water in said tank, having its other end extending at least partially through and communicating through said second valve head; and (b) means for attaching the upper end of said second tubular member to said trip lever.

6. The flush valve of claim 5 wherein said means for arresting comprises a horizontal cross member positioned normal to the axis of said first tubular member and supported by at least one vertical member attached to said first tubular member, said horizontal cross member supporting a collar adapted to engage said second tubular member.

7. The flush valve of claim 1 wherein said means for attaching said second valve head to said trip lever comprises:

(a) a second hollow tubular member open at its upper end, having one end extending through and beyond said second valve head, and having one or more openings penetrating the wall of said tubular member in the region below said second valve head; and (b) means for attaching the upper end of said second tubular member to said trip lever.

8. The flush valve of claim 7 wherein the lower end of said first tubular member is open.

9. The flush valve of claim 7 wherein the lower end of said first tubular member is closed.

* * * * *